United States Patent [19]

Bisbee

[11] Patent Number: 4,779,872

[45] Date of Patent: Oct. 25, 1988

[54] GOLF SWING ALIGNMENT DEVICE

[76] Inventor: David A. Bisbee, 704 Highland, Manhattan Beach, Calif. 90266

[21] Appl. No.: 15,158

[22] Filed: Feb. 17, 1987

[51] Int. Cl.[4] ..... A63B 69/36

[52] U.S. Cl. ..... 273/186 C; 273/187 R

[58] Field of Search ..... 273/186 R, 186 C, 187 R, 273/187 A, 187 B, 183 A, 196

[56] References Cited

U.S. PATENT DOCUMENTS

| | | | |
|---|---|---|---|
| D. 234,210 | 1/1975 | Menendez | 273/187 R X |
| 2,150,580 | 3/1939 | Crowley | 273/187 R |
| 2,169,407 | 8/1939 | Crowley | 273/187 R |
| 3,510,136 | 5/1970 | Ruspoli | 273/186 R |
| 3,550,946 | 12/1970 | Menendez | 273/187 R |

FOREIGN PATENT DOCUMENTS

| | | | |
|---|---|---|---|
| 383767 | 11/1932 | United Kingdom | 273/186 R |

*Primary Examiner*—George J. Marlo

*Attorney, Agent, or Firm*—Michael Bak-Boychuk

[57] ABSTRACT

A golf swing training assembly is formed from engageable parts including two transverse segments selectively mounted on lateral strips. An arcuate, planar swing path guide is engaged to one of the segments for deployment within the frame thus formed by insertion of the segment between a resilient block and a edge lip formed therein. A vertical index is then supported under the leading edge of the guide to direct the club swing to the horizontal arc of the guide.

1 Claim, 1 Drawing Sheet

GOLF SWING ALIGNMENT DEVICE

BACKGROUND OF THE INVENTION

1. Field of the Invention

The present invention relates to golf swing training devices and more particularly to geometric assemblies for aligning the stance and swing of a golf player.

2. Description of the Prior Art

The kinematics of impact of a club head against a golf ball have had extensive consideration in the past. In each instance the desired object is to maximize the energy transferred to the golf ball, thereby maximizing its flight trajectory. Since the elevation (vertical angle) at impact is largely determined by the club face geometry the dominant aspects affecting ball flight are the speed of the swing and its alignment with path azimuth. Simply, it is desired to impart the maximum speed to the club head at impact and to align the impact vector directly along the path of the ball. Of course, any face misalignments which impart angular momentum to the ball (hook or slice) reduce the energy transfer to the ball trajectory and substantial training is required to minimize such events.

In the past various training devices were provided which, in one way or another, assist the player in developing a proper golf swing. Such teachings are exemplified in U.S. Pat. Nos. 3,550,946 to Menendez; 2,169,407 to Crowley; 4,563,010 to McDornan et al.; 4,146,231 to Merkle et al.; 4,544,161 to Guendling, Jr., and 4,526,373 to Medlock. While suitable for their purposes each of the foregoing teachings addresses one or more aspects of the dynamics of a golf swing and a simplified, inexpensive and fully accommodated teaching aid is therefore desired. It is one such golf swing teaching aid that is disclosed herein

SUMMARY OF THE INVENTION

Accordingly it is the general purpose and object of the present invention to provide geometric assembly including indicia for the stance and path of a golf swing.

Other objects of the invention are to provide a golf swing teaching aid including indicia for swing path and club alignment.

Yet further objects if the invention are to provide a golf swing practice assembly which is easy to produce comprises few parts and is conveniently erected.

Briefly, these and other objects are accomplished within the present invention by providing an adjustable rectangular frame including a first tubular segment and a second tubular segment conformed for selective pin engagement to framework strips defining a rectangle. The first tubular segment then provides an alignment index for the feet of the player with the second tubular segment displaced therefrom to accommodate the path of the golf club. An arcuate planar guide is then engaged to the first segment by inserted receipt between a tangential lip and a foam rubber block fixed to the face thereof. This guide then directs the horizontal path of the club head along its arc towards the golf ball placed adjacent an index mark.

By placing the guide within the rectangle formed by the segments and vertical strips the horizontal path of the club head is directed to align at ball impact with the desired path of the ball. Moreover, a vertical flag assembly is inserted by its base under the leading edge of the guide thus compelling the player to follow the arc on the way to impact.

In this manner the angular alignment at impact and all the vertical angles in the course of the swing are properly aligned for developing the proper stance and geometry habits in the player.

DESCRIPTION OF THE PREFERRED EMBODIMENT

Figure 1:
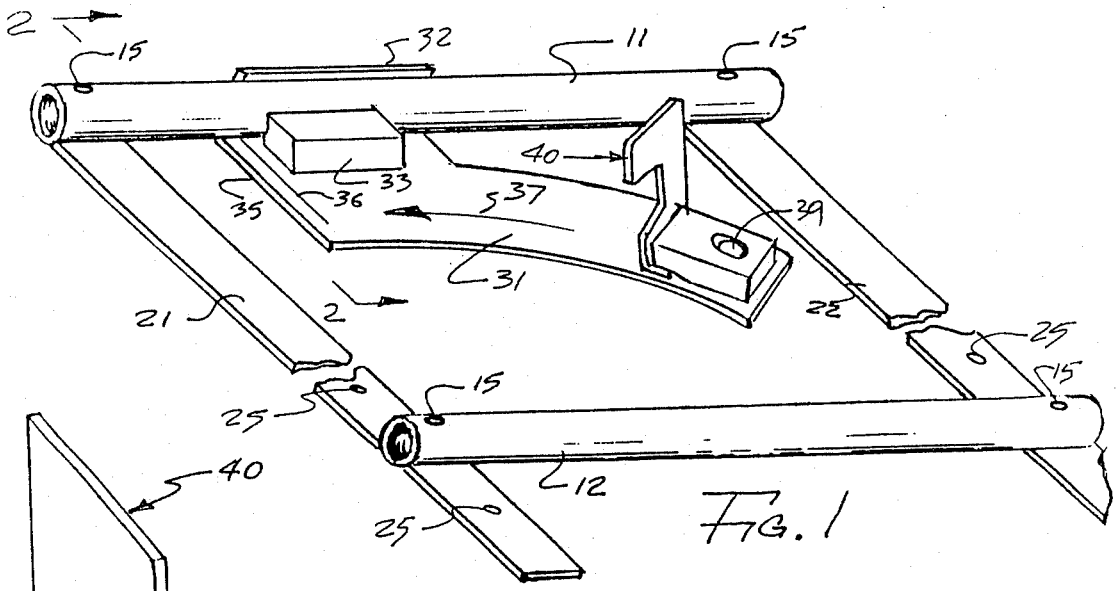
FIG. 1 is a perspective illustration of the inventive golf training assembly aligned for use.

As shown in FIGS. 1 through 4 the inventive training assembly, generally designated by the numeral 10, comprises a first tubular segment 11 and a second tubular segment 12, both of substantially equal length and both including pins 15 at their ends projecting along common radial planes therefrom. A first and second planar strip 21 and 22 are each provided with plural openings 25 conformed to receive pins 15 at the end of each segment.

In this form, segments 11 and 12 and strips 21 and 22 may be engaged to each other to form a rectangular frame in which the tube segment sides are separated by the selective engagement of openings 25. Segment 12 may then serve as an index for the feet of the player with the club swing directed by structure engageable to segment 11.

More specifically, the path of the club head is directed along an arcuate planar guide 31 provided with a tangential lip 32 adjacent a foam rubber block 33 spaced to receive segment 11 therebetween. For this purpose lip 32 is inclined towards the block to form a gap somewhat smaller than the extetior diameter of segment 11. Thus segment 11 is grasped by resilient exposure between the lip and the adjacent block and is consequently fixed in its placement.

The leading edge 35 of guide 31 is cut to an orthogonal alignment with an index mask 36 inscribed adjacent the edge for ball placement. Yet another scribe in the form of an arcuate arrow 37, is inscribed on the face of the guide for visual reference in the course of a swing.

Figure 5:
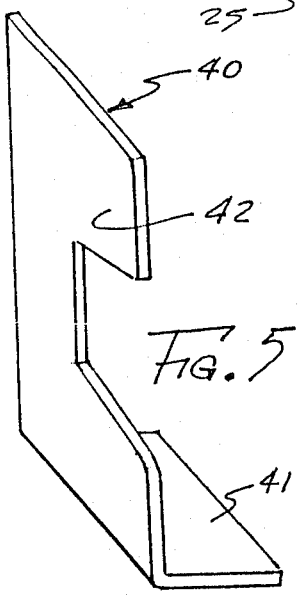
FIG. 5 is a perspective illustration of a vertically supported flag useful with the invention herein.
Figure 2:
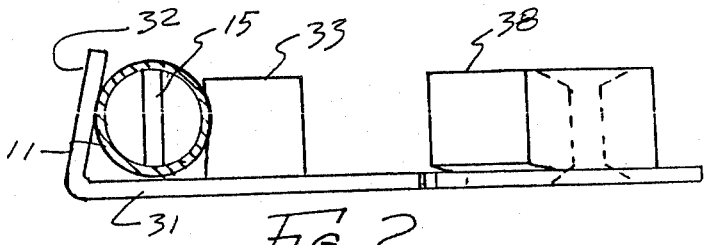
FIG. 2 is a sectional end view taken along line 2—2 of FIG. 1.
Figure 3:
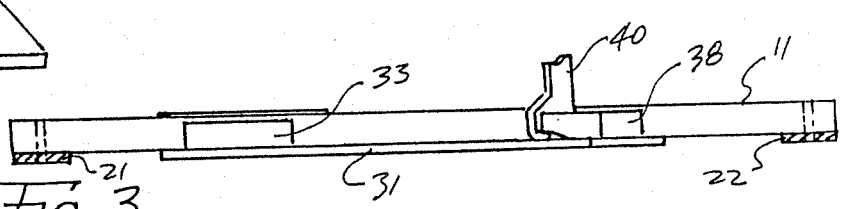
FIG. 3 is a front view in partial section, of the assembly shown in FIG. 1.
Figure 4:
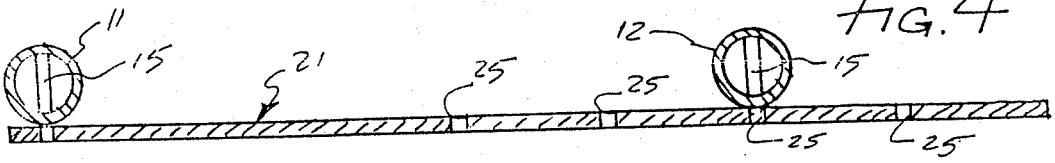
FIG. 4 is an end view of the inventive assembly shown in FIG. 1.

To insure a horizontally arcuate path an L shaped flag assembly 40, shown in FIG. 5, is inserted by a base lip 41 below the leading edge of a resilient block 38 to present a vertical flag surface 42 which the player shall avoid in the course of the swing. This foam rubber block 38 is fixed by a fastener 39 adjacent the end of the guide both to provide the weight for retaining the flag 40 and to absorb the impact on the occurrence when the flag is hit.

The foregoing elements may be conveniently formed from a variety of polymer materials, preferably from polyvinylchloride, polypropylene or polyethylene. The array of elements can then be geometrically aligned by those teaching the player and once so aligned can be reassembled at will for repeated practice.

Obviously, many modifications and changes may be made to the foregoing without departing from the spirit of the invention. It is therefore intended that the scope of the invention be determined solely on the claims appended hereto.

What is claimed is:

1. A golf swing teaching assembly comprising:

a first and second elongate tubular segment each provided with transversely projecting pins proximate the ends thereof;

a first and second elongate strip each including longitudinally spaced openings for receiving said pins of said first and second segments, whereby said strips and segments are engageable to each other to form a rectangular framework;

an arcuate planar guide receipt of said first segment along a tangent thereof for deployment within said framework; including a tangential lip projecting orthogonally from the edge of said guide and a first resilient block attached to said guide in a spaced relationship relative said lip in a spaced alignment smaller than the width of said first segment for engaging said first segment therebetween by resilient compression of said first block, whereby said guide is engaged in a tangential alignment relative said first segment;

a second resilient block partially attached to said guide; and a planar indicator including an orthogonal base for insertion between said second block and said guide.

* * * * *